US005480086A

United States Patent [19]

Nakashima et al.

[11] Patent Number: 5,480,086

[45] Date of Patent: Jan. 2, 1996

[54] NON-CONTACT WEB CONVEYING APPARATUS

[75] Inventors: Hiroshi Nakashima; Sanshiro Fukuhara, both of Kanagawa, Japan

[73] Assignee: Fuji Photo Film Co., Ltd., Kanagawa, Japan

[21] Appl. No.: 443,677

[22] Filed: May 18, 1995

Related U.S. Application Data

[63] Continuation of Ser. No. 229,103, Apr. 18, 1994, abandoned, which is a continuation of Ser. No. 814,068, Dec. 24, 1991, abandoned, which is a continuation of Ser. No. 633,206, Dec. 31, 1990, abandoned, which is a continuation of Ser. No. 408,349, Sep. 18, 1989, abandoned.

[30] Foreign Application Priority Data

Sep. 19, 1988 [JP] Japan ..... 63-232592

[51] Int. Cl.[6] ..... B65H 20/00

[52] U.S. Cl. ..... 226/97; 34/641

[58] Field of Search ..... 226/7, 97; 34/156, 34/110

[56] References Cited

U.S. PATENT DOCUMENTS

| | | | |
|---|---|---|---|
| 3,549,070 | 12/1970 | Frost et al. | 226/97 |
| 3,587,177 | 6/1971 | Overly | 34/160 |
| 3,873,013 | 3/1975 | Stibbe | 34/156 |
| 4,074,841 | 2/1978 | Kramer et al. | 226/97 |
| 4,182,472 | 1/1980 | Peekna | 226/97 |
| 4,201,323 | 5/1980 | Stibbe et al. | 226/97 |
| 4,601,116 | 7/1986 | Krimsky | 226/97 |
| 4,698,914 | 10/1987 | Shu et al. | 226/97 |
| 4,785,986 | 11/1988 | Daane et al. | 226/97 |

FOREIGN PATENT DOCUMENTS

| | | |
|---|---|---|
| 0291832 | 5/1988 | European Pat. Off. . |
| 52-150866 | 12/1977 | Japan . |
| 53-551 | 1/1978 | Japan . |
| 2013600 | 8/1979 | United Kingdom . |
| 2025346 | 1/1980 | United Kingdom . |

*Primary Examiner*—Daniel P. Stodola
*Assistant Examiner*—Eileen A. Dunn
*Attorney, Agent, or Firm*—Sughrue, Mion, Zinn, Macpeak & Seas

[57] ABSTRACT

A non-contact web conveying apparatus in which static pressure support type air blowing boxes are arranged on both sides of a web in such a manner that the air blowing boxes are provided in staggered positions in the direction of movement of the web. The web is conveyed while being suspended so that the web waves continuously in the direction of movement. A protrusion is provided in the middle of the air blowing box between air jetting outlets which are formed at both opposite edges of the air blowing box. In this way, the web is stably conveyed without creasing or fluttering.

7 Claims, 4 Drawing Sheets

NON-CONTACT WEB CONVEYING APPARATUS

This is a Continuation of application No. 08/229,103 filed Apr. 18, 1994, now abandoned which is a continuation of Ser. No. 07/814,068 filed Dec.24, 1991, now abandoned, which is a continuation of Ser. No. 07/633,206, filed Dec. 31, 1990, now abandoned, which is a continuation of Ser. No. 07/408,349, filed Sep. 18, 1989, now abandoned.

FIELD OF THE INDUSTRIAL APPLICATION

This invention relates to an apparatus for conveying a long belt-shaped support of plastic film or paper (hereinafter referred to as "a web") in a non-contact mode (hereinafter referred to as "a non-contact web conveying apparatus"), and more particularly to a non-contact web conveying apparatus for continuously conveying a web during the manufacture of photo-sensitive materials such as photographing films and photographic papers, magnetic recording materials such as magnetic sound recording tapes, or recording materials such as pressure-sensitive copying sheets and heat-sensitive copying sheets.

DESCRIPTION OF THE PRIOR ART

Heretofore, a web conveying apparatus with rollers has been used to convey a web of plastic film or paper. In this case, the web is brought into contact with the rollers, and accordingly it may be scratched or creased by the rollers. Thus, the product may be damaged by the rollers. In the case where the web conveying apparatus is used for conveying a web having film layers on both sides, the web is more liable to be damaged by the rollers. In order to overcome this difficulty, a web conveying apparatus has been proposed in the art which jets an air stream onto the web in order to suspend it in the air; that is, it conveys the web without contacting it.

In a typical example of the non-contact web conveying apparatus of this type, static pressure support type air blowing boxes are arranged on both sides of the web so that they are in staggered positions in the direction of movement of the web. The air blowing boxes thus provide jet air streams vertically from their surfaces which confront the web, to suspend the web so that it waves continuously in the direction of movement of the web (as disclosed, for instance, by Japanese Patent Application Publication Nos. 551/1978 and U.S. Pat. No. 3,549,070). In this operation, in order to stably convey the web, the configuration and size of the air blowing boxes and the arrangement and intervals of the air jetting outlets must be designed to sufficiently satisfy specific conditions. Parts of the conditions have been disclosed by UK Patent No. 2,013,600B. According to the above-mentioned application, the air jetting outlets of each of the air blowing boxes are slits formed at both opposite edges of the air blowing box, and the air jetting angle of each of the air jetting outlets is vertical to the air flowing surface of the box. In order to stably convey the web, the distance W between front and rear air jetting outlets formed along opposite edges of the air blowing box, and the distance P between adjacent air pressure applying positions (i.e., the distance between adjacent air blowing boxes) on the same side of the web should meet the following relation:

$$W > P/6$$

The data W should be relatively small (preferably one-fifth (1/5) or less than the width of the web). Therefore, in practice, one of the conditions for stable conveyance of the web is that the interval P is small.

Accordingly, in the conventional non-contact web conveying apparatus, it is necessary to provide a number of air blowing boxes, and the quantity of air jetted therefrom is large. This produces the result that the apparatus is costly both in equipment and running costs. In order to overcome the draw-backs, the present inventor has filed a non-contact web conveying method (U.S. Pat. No. 4,836,429) in which the above-described difficulties accompanying a conventional non-contact web conveying apparatus have been eliminated. In such an apparatus, the web can be stably conveyed with a smaller quantity of jet air, and both the equipment and operation costs are lower.

The non-contact web conveying method filed by the present inventor will be described with reference to FIGS. 3(*a*) and 3(*b*). That is, in the method as shown in FIGS. 3(*a*) and 3(*b*), static pressure support type air blowing boxes 3 are arranged on both sides of a web so that they are in staggered positions in the direction of movement of the web 1. As a result, the web is conveyed while being suspended in such a manner that it waves continuously in the direction of movement. The air jet angle θ of each of air jetting outlets 4*a* and 4*b* formed in each of the static pressure support type air blowing boxes 3 along both opposite edges falls within a range of between 15° to 45° with respect to a plane perpendicular to the air jetting surface. The distance W between the air jetting outlets is at least 20 cm, and is also 30% to 80% of the width of the web.

In order to stably convey the web without creasing or fluttering it, the air streams jetted from the two air jetting outlets 4*a* and 4*b* must be equal both in quantity and in speed, and further, they must exhibit symmetrical jet angles. If the above-mentioned requirements are not sufficiently satisfied, then the web is brought into contact with the air blowing boxes, resulting in damage to the web and causing an unacceptable product. This tendency depends greatly on the distance between the air jetting outlets 4*a* and 4*b* and the size of the air blowing box.

In order to assure that the air streams jetted from the two air jetting outlets exhibit equal jet quantity, jet speed and symmetrical jet angles, the two air jetting outlets must be formed with high precision so that they are equal (or symmetrical) in configuration. However, to do so is technically difficult, and is not practical due to the manufacturing cost. When the air blowing boxes are bulky, the formation of the air jetting outlets requires higher precision machining work. In the case where the air blowing boxes are used in a high temperature atmosphere, they will be strained by heat, and therefore it is more difficult to maintain a constant air jetting outlet or to provide accuracy. Further, in the first prior art method described, the web is prevented from contacting the air blowing boxes by increasing the flow rate of the air streams jetted thereby to suspend the web more positively. However, the method is still disadvantageous in that it is fundamentally unstable during the conveyance of a web, and it results in high energy cost because of the increase of the flow rate of the jet air streams.

Accordingly, it is an object of the present invention to eliminate the above-described difficulties accompanying a conventional non-contact web conveying method. More specifically, an object of the invention is to provide a non-contact web conveying apparatus in which, even when the jet air streams utilize a small flow rate, the web is never creased nor fluttered, and moreover it does not contact the air blowing boxes.

SUMMARY OF THE INVENTION

The foregoing object of the invention has been achieved by the provision of a non-contact web conveying apparatus in which static pressure support type air blowing boxes are arranged on both sides of a web in such a manner that the air blowing boxes are provided in staggered positions in the direction of movement of the web. In this way, the web is conveyed while being suspended so that the web waves continuously in the direction of movement. According to the invention, a protrusion is provided in the middle of the air blowing box between air jetting outlets which are formed at both opposite edges of the air blowing box.

The foregoing object of the invention has been more effectively achieved by the provision of the above-described non-contact web conveying apparatus, in which, according to the invention, the protrusion has a width (b) in the direction of movement of the web which is 30% to 70% of the distance (W) of the front and rear air jetting outlets, a height (a) from the air jetting surface which is 5 mm to 25 mm, an angle θ ranged from 45° to 135° formed by the rise walls with respect to the air jetting surface, and a length (c) in the direction of width of the web which is larger than the width of the web. The foregoing is described in detail below, with reference to the figures.

PRIOR ART

Figure 3A:
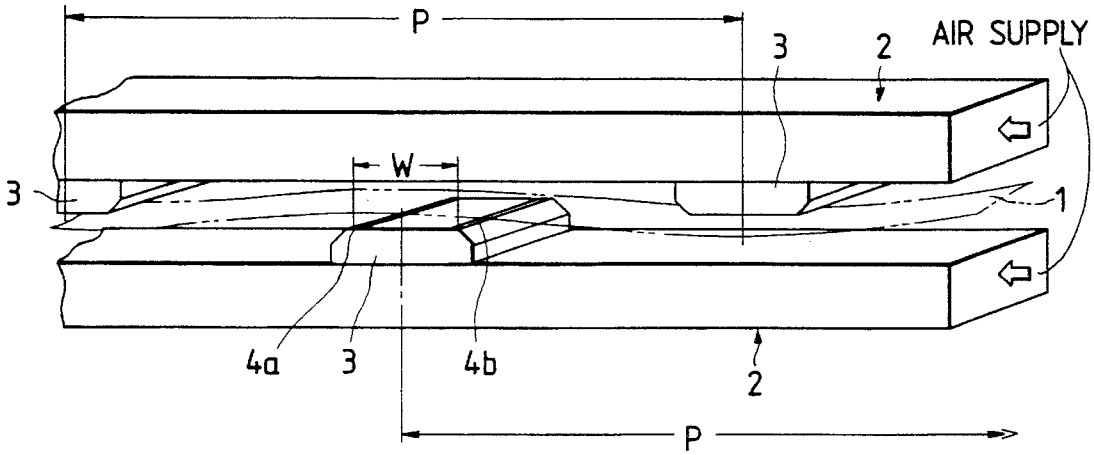
FIG. 3(a) PRIOR ART
Figure 3B:
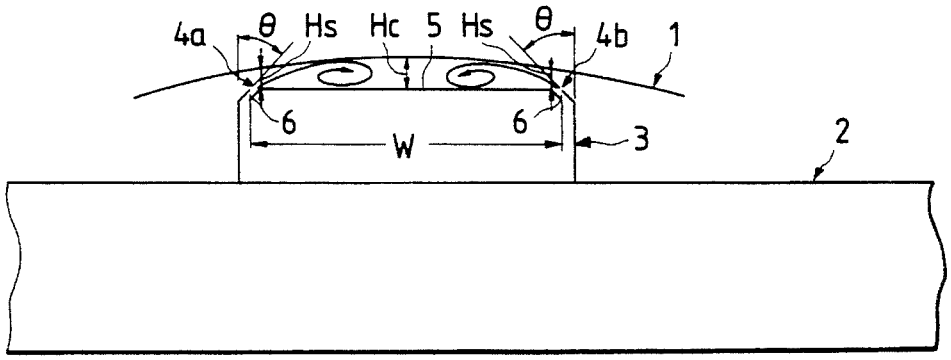
FIG. 3(b) PRIOR ART

FIG. 3(*a*) is a perspective view showing one example of a conventional non-contact web conveying apparatus; and, FIG. 3(*b*) is a sectional diagram showing the positional relationship between an air blowing box and a web in the conventional web conveying apparatus.

PRIOR ART

Figure 4A:
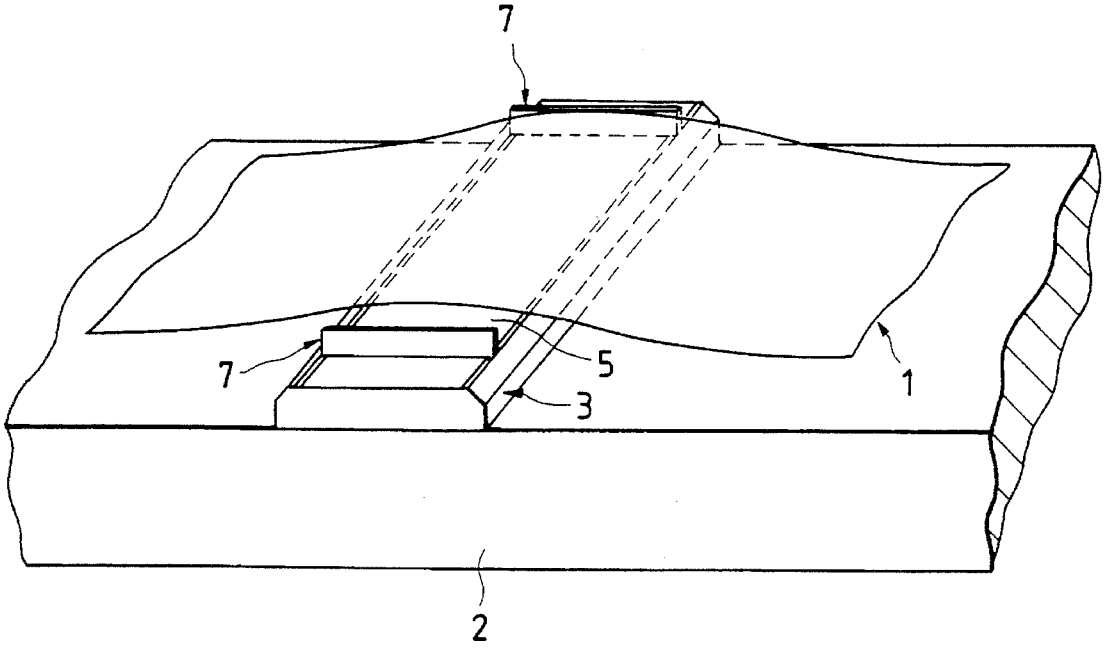
FIG. 4(a) PRIOR ART
Figure 4B:
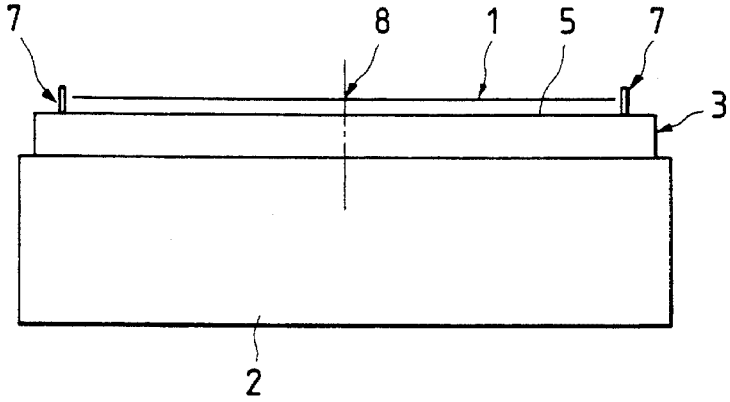
FIG. 4(b) PRIOR ART

FIGS. 4(*a*) and (*b*) are a perspective view and front view, respectively, showing another example of the conventional non-contact web conveying apparatus.

DETAILED DESCRIPTION OF THE PREFERRED EMBODIMENT

In this invention, a static pressure support type air blowing box 3, as shown in FIG. 3(*b*), has air jetting outlets 4*a* and 4*b* at the front and rear edges of the air jetting surface 5 which is arranged on a duct and chamber 2 so as to confront the web 1, and jets air streams to maintain the web 1 above the air jetting surface 5 with static pressure.

The air jetting outlets 4*a* and 4*b* formed in the air blowing box at the opposite edges have slit guides to determine the air jetting direction. In general, it is desirable that the air jetting outlets are in the form of a slit; however, they may be formed as a number of through-holes linearly arranged. When necessary, an additional air jetting outlet or outlets may be provided between the front and rear air jetting outlets 4*a* and 4*b* of the air blowing box. The direction of air streams jetted from the front and rear air jetting outlets of the air blowing box are inclined inwardly at an angle in a range from 15° to 45° with respect to a plane vertical to the air jetting surface 5.

The provision of the protrusion in the middle of the static pressure support type air blowing box between the front and rear air jetting outlets, as shown in FIG. 3(*b*), maximizes the amount of float Hc of the web at the middle of the air blowing box, and minimizes the amount of float Hs of the web at the front and rear air jetting outlets 4*a* and 4*b*. That is, the possibility of the web contacting the air blowing box is decreased as the amount of float Hs increases. Under the same web conveying conditions, the amount of float Hs can be increased by increasing the flow rate of air streams jetted from the air blowing box. However, increasing the flow rate of air streams may result in the fluttering of the web, and will increase the running cost. On the other hand, the amount of float Hs can be increased by a method in which, as shown in FIGS. 4(*a*) and 4(*b*), guide boards 7 are provided on the air jetting surface 5 of the air blowing box so that they are located on both sides of the web to limit the sideward flow of the air streams flowing, thereby increasing the amount of float of the web. However, the method still has the following disadvantages. When the web is flexible, both edge portions of the web are raised by the air streams colliding against the guide boards 7, with the result that a crease 8 may be formed in the web at the center of the width; that is, the product may be unacceptable. That is, for the web with low rigidity, it is not preferable to limit the air streams flowing sidewardly of the web.

Figure 1:
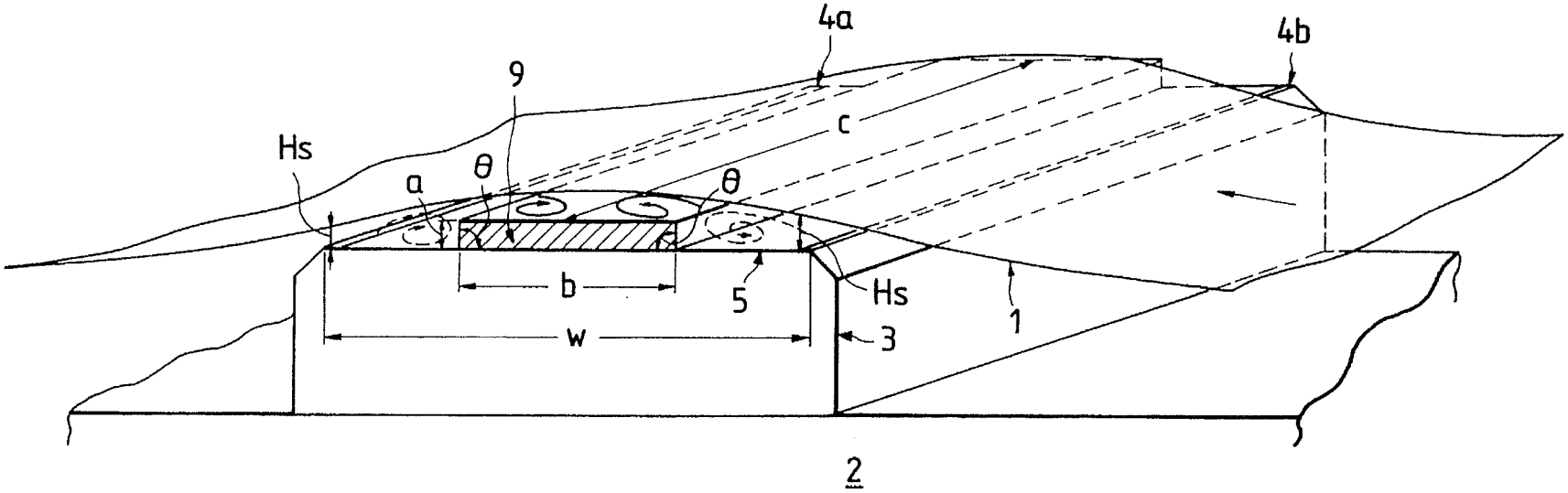
FIG. 1 is a perspective view of an air blowing box in a non-contact web conveying apparatus according to this invention.

In view of the foregoing, in the non-contact web conveying apparatus according to the invention, as shown in FIG. 1, the aforementioned protrusion 9 is provided on the air jetting surface of the air blowing box 3 in such a manner that it covers the entire width of the web 1. With the apparatus, the amount of float Hs can be increased without increasing the flow rate of air streams. The air streams jetted from the slits 4*a* and 4*b*, flowing along the air jetting surface, collide against the rise walls of the protrusion 9. As a result, the air streams are partially turned, thus increasing the amount of float Hs. In this operation, no crease is formed in the web.

It is not always necessary that the rise walls of the protrusion 9 be at right angles with the air jetting surface; that is, the angle may be ranged from 45° to 135°.

The provision of the protrusion 9 can eliminate the difficulty that the web is suspended unstably because of a difference in configuration (or accuracy) between the two slits which is likely to occur with the use of air blowing boxes in which the distance W between the slits (or the distance between the air jetting outlets) is relatively large.

The protrusion 9 makes parts of the air streams jetted from the two slits independent of each other, thus reducing the mutual interference of the air streams. Hence, the web can be floated stably without use of the slits formed with high accuracy.

The dimensions of the protrusion 9 are important in maintaining the float stability of the web. If the protrusion 9 is excessively large, then the distance between the web and the protrusion 9 is small. As a result, the web may contact the protrusion 9. Therefore, it is preferable that the size of the protrusion 9 is such that the width (b) in the direction of movement of the web is 30 to 70% of the distance W between the slit, the height (a) is in a range of from 5 mm to 25 mm, the angle θ of the rise walls with the air jetting surface is in a range from 45° to 135°, and the length (c) is at least the width of the web.

Various embodiments of the above-described invention are possible without departing from the scope thereof. For example, the protrusion 9 may be provided as follows.

Figure 2A:
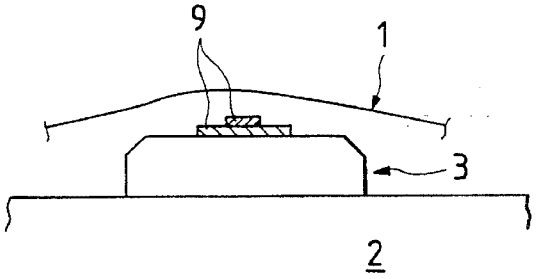
FIG. 2, parts (a) , (b) and (c) are perspective views showing a modification of the non-contact web conveying apparatus according to the invention.
Figure 2B:
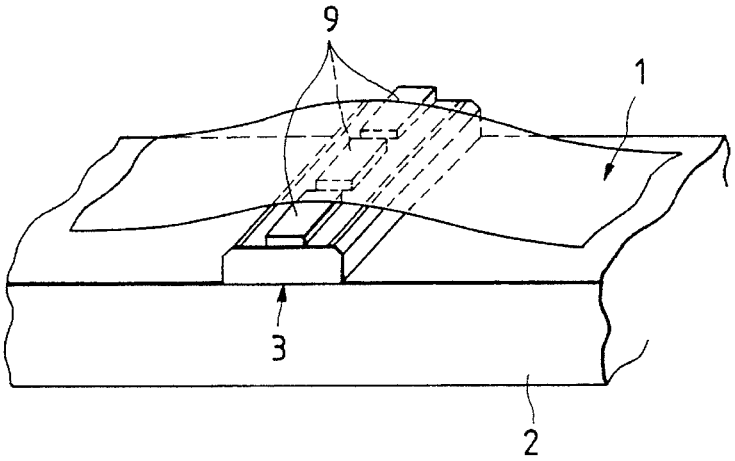
Figure 2C:
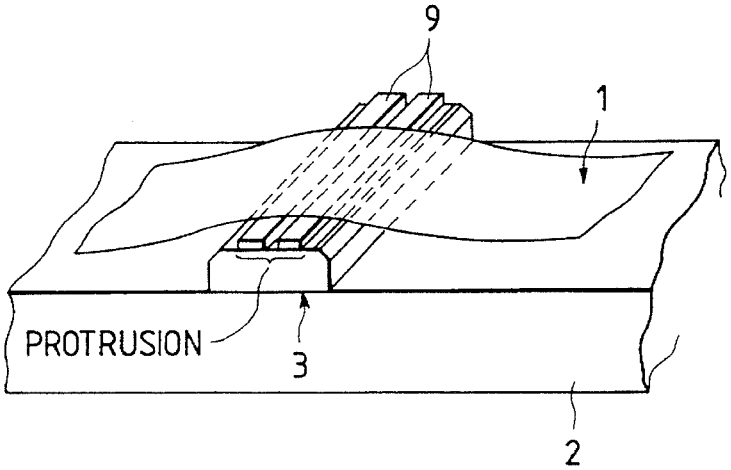

In the above-described embodiment, the protrusion 9 is made up of only one board; however, it may be of a multi-layer structure as shown in FIG. 2(*a*), providing satisfactory effects.

In addition, the protrusion 9 may be applied not only to the air blowing box having two slits, but also to an air blowing box which has lines of through-holes instead of the slits.

Further, in the above-described embodiment, the protrusion 9 is one unit extended in the direction of width of the web. However, the invention is not limited thereto or thereby. For instance, the same effect may be obtained by arranging a plurality of boards at intervals as shown in FIG. 2(*b*).

It is not always necessary that the protrusion be uniform in section. That is, it may be varied in the direction of width of the web, or in the direction of movement of the web.

The material and structure of the protrusion 9 are not limited. It may be formed by bending a plate, or it may be solid. Furthermore, it may be made of a porous material, if it shows resistance against the flow of the air stream.

In the above-described embodiment, only one protrusion is used; however, a plurality of protrusions may be arranged as shown in FIG. 2(*c*).

EXAMPLE

A metal protrusion having a height (a) of 10 mm, a width (b) of 300 mm in the direction of movement of the web, and a length (c) of 1200 mm in the direction of width of the web was mounted on the air jetting surface 5 of an air blowing box 3 having air jetting outlets spaced by W=600 mm from each other. And a PET web, 1000 mm in width and 100 μm in thickness, was floated under tension=5 kg/width. In this operation, the flow rate of air streams jetted from each blowing box was 15 $m^3$/min.

In the experiment, the web was not creased nor fluttered; that is, it was suspended stably. The minimum amount of float Hs was up to 37 mm. With the air blowing box having no protrusion as shown in FIG. 3(*b*), the minimum amount of float Hs was 25 mm, and the web often contacted the air blowing box; that is the web was suspended unstably. As is apparent from the above description, with the non-contact web conveying apparatus of the invention, the minimum amount of float was increased by 12 mm and the web was suspended stably, without increasing the flow rate of the air streams jetted from the air blowing boxes. That is, the web was conveyed smoothly without contacting the air blowing boxes.

Thus, the non-contact web conveying apparatus according to the invention has the following effects:

Without increasing the flow rate of air streams, the minimum amount of float can be increased, whereby the possibility of the web contacting the air blowing boxes can be reduced. In the case of obtaining a given amount of float, in the non-contact web conveying apparatus of the invention, the flow rate of air streams jetted from the air blowing boxes can be smaller than in the conventional non-contact web conveying apparatus, with the result that the energy cost is reduced.

Further, in the web conveying operation using large air blowing boxes (i.e., in W) or high temperature air blowing boxes, the web conveying operation is scarcely affected by the characteristics of the slits (the width and angle of the slits) of the air jetting outlets, so that the web is not fluttered, but rather is stably suspended.

Finally, it is unnecessary to form the slits of the air jetting outlets with high accuracy, and the manufacturing cost of the air blowing boxes is greatly reduced.

What is claimed is:

1. In a non-contact web conveying apparatus comprising:

at least two static pressure support type air blowing boxes arranged in staggered positions on both sides of a web so that said web is conveyed while being suspended and said web waves continuously in a direction of movement, each of said air blowing boxes having air jetting outlets formed at opposite edges thereof, said air jetting outlets providing an air flow over an air jetting surface, on at least one of said air blowing boxes, said air jetting outlets being formed integrally and flush with said air jetting surface, the improvement comprising:

at least one protrusion centrally located on said air jetting surface in a middle section equi-distant from said air jetting outlets, said at least one protrusion having a length, width, and height that is sufficient in comparison with an area of said air jetting surface, to provide an increased air pressure without increasing said air flow to stably convey said web, wherein said web would contact said air jetting surface in the absence of said air flow and said protrusion;

wherein said width is measured in said direction of movement and is 30% to 70% of a distance between said air jetting outlets, said height is measured from an air jetting surface and is in a range from 5 mm to 25 mm, an angle θ is formed by rise walls of said protrusion and said air jetting surface, said angle θ being in a range from 45° to 135°, and said length is measured in the direction of width of said web and is larger than the width of said web.

2. A non-contact web conveying apparatus as claimed in claim 1, wherein said at least one protrusion comprises a single unit extended in a direction of width of said web.

3. A non-contact web conveying apparatus as claimed in claim 1, wherein said at least one protrusion comprises a plurality of boards spaced in intervals in a direction of width of said web.

4. A non-contact web conveying apparatus as claimed in claim 1, wherein said at least one protrusion comprises a plurality of boards spaced in intervals in a direction of movement of said web add said plurality of boards as a group are equidistant from said air jetting outlets.

5. A non-contact web conveying apparatus as claimed in claim 1, wherein said at least one protrusion is made of a solid material.

6. A non-contact web conveying apparatus as claimed in claim 1, wherein said at least one protrusion is made of a porous material.

7. A non-contact web conveying apparatus as claimed in claim 1, wherein said at least one protrusion comprises a multi-layer structure and wherein individual layers of said multi-layer structure vary with respect to each other in width.

* * * * *